United States Patent [19]

Killinger

[11] Patent Number: 4,503,791

[45] Date of Patent: Mar. 12, 1985

[54] CAM CONTROLLED GATE SPRING FOR CHAIN STITCH SEWING MACHINE

[75] Inventor: Karl H. Killinger, Dover, N.J.

[73] Assignee: The Singer Company, Stamford, Conn.

[21] Appl. No.: 600,928

[22] Filed: Apr. 16, 1984

[51] Int. Cl.[3] ..... D05B 3/14; D05B 57/02; D05B 97/02; D05B 97/10

[52] U.S. Cl. ..... 112/199; 112/112; 112/169

[58] Field of Search ..... 112/110, 112, 159, 166, 112/169, 199

[56] References Cited

U.S. PATENT DOCUMENTS

| | | | |
|---|---|---|---|
| 1,809,192 | 6/1931 | Cahill et al. | 112/169 |
| 3,165,080 | 1/1965 | Castelletti | 112/169 X |
| 3,837,306 | 9/1974 | Doyel | 112/169 |
| 4,401,043 | 8/1983 | Peterson | 112/199 |
| 4,411,210 | 10/1983 | Killinger | 112/199 |

FOREIGN PATENT DOCUMENTS

| | | |
|---|---|---|
| 54-95356 | 12/1977 | Japan . |
| 54-48872 | 9/1980 | Japan . |

*Primary Examiner*—Wm. Carter Reynolds

*Attorney, Agent, or Firm*—William V. Ebs; Robert E. Smith; Edward L. Bell

[57] ABSTRACT

A chain stitch sewing machine including a looper and cam assembly with cam tracks engageable by an actuator, a gate pivotally mounted on the assembly and a spring with one free end to engage and move the gate into positions controlling actuator movement between the tracks is provided with camming surfaces on a fixed member for lifting the free end of the spring to the top of the gate for passage from one side to the other.

5 Claims, 10 Drawing Figures

CAM CONTROLLED GATE SPRING FOR CHAIN STITCH SEWING MACHINE

BACKGROUND OF THE INVENTION

1. Field of the Invention

The invention relates to chain stitch sewing machines.

2. Description of the Prior art

Single thread chain stitch sewing machines with pivoted thread seizing loopers are commonly used for sewing buttons onto garments and for hemming or tacking. Such a machine may be seen, for example, in U.S. Pat. No. 4,411,210 of Karl H. Killinger for "Actuating Mechanism for a Double Pointed Looper in a Sewing Machine" which issued Oct. 25, 1983.

A machine as described in said patent includes a pivotably mounted cam having a looper affixed thereto, and spring means which biases the looper cam assembly axially to a position wherein tracks in the cam are disposed for engagement with a cam actuator, and a gate for controlling access to the cam tracks is disposed for interaction with a gate regulating spring. During operation of the machine, the looper is pivoted to bring looper points into cooperation with a sewing needle and so provide for the formation of chain stitches. However, faulty operation is sometimes experienced due to engagement of the gate regulating spring with the rear face of the gate when loop penetration should occur, and a consequent movement of the looper cam assembly in oppostion to its axial bias sufficient to result in skipped stitches.

It is a prime object of the present invention to provide an improved chain stitch sewing machine in which a gate regulating spring is prevented from axially deflecting a looper cam assembly.

It is another object of the invention to provide an improved chain stitch sewing machine in which a gate regulating spring is lifted to the top of the gate for passage from one side of the gate to the other during pivotal reciprocation of a looper cam assembly.

Other objects and advantages of the invention will become apparent during a reading of the specification taken in connection with the accompanying drawings.

SUMMARY OF THE INVENTION

A chain stitch sewing machine is provided according to the invention with: a looper and cam assembly, the cam including two intersecting cam tracks, and the looper including a pair of loop seizing points; resilient means biasing the assembly axially into a limited position in the frame of the machine; an actuator to slidingly engage the cam tracks alternately and effect pivotal motion of the assembly alternately placing each of the two loop seizing points in cooperative engagement with the needle for the formation of chain stitches; a gate pivotally mounted on the cam; a spring having one end affixed in the machine and a free end to alternately engage opposite side edge of the gate and move the gate into positions controlling actuator movement between the tracks; and a fixed member having camming surfaces thereon engageable by the spring with flexure thereof by the gate for lifting the free end of the spring to the top of the gate for passage from one side to the other.

DESCRIPTION OF THE INVENTION

Figure 1:
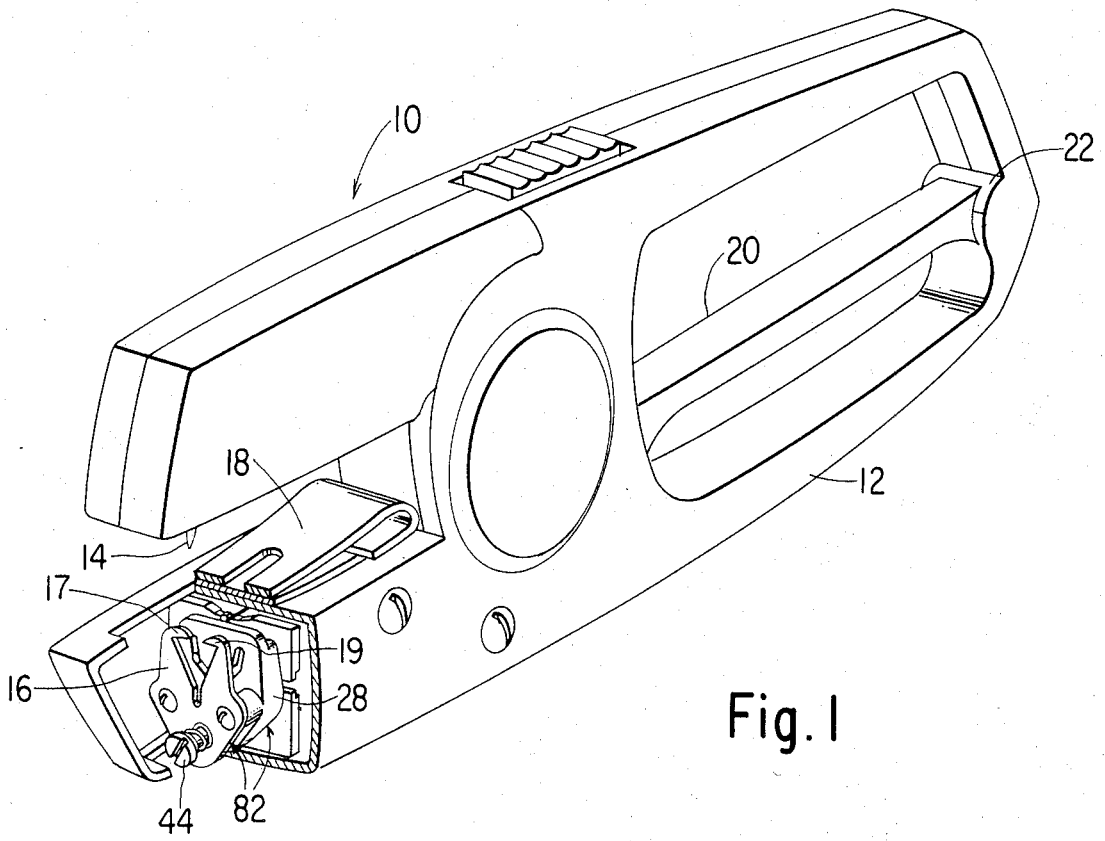
FIG. 1 is a perspective view of a hand operable sewing machine which includes the cam controlled gate spring arrangement of the invention.
Figure 2:
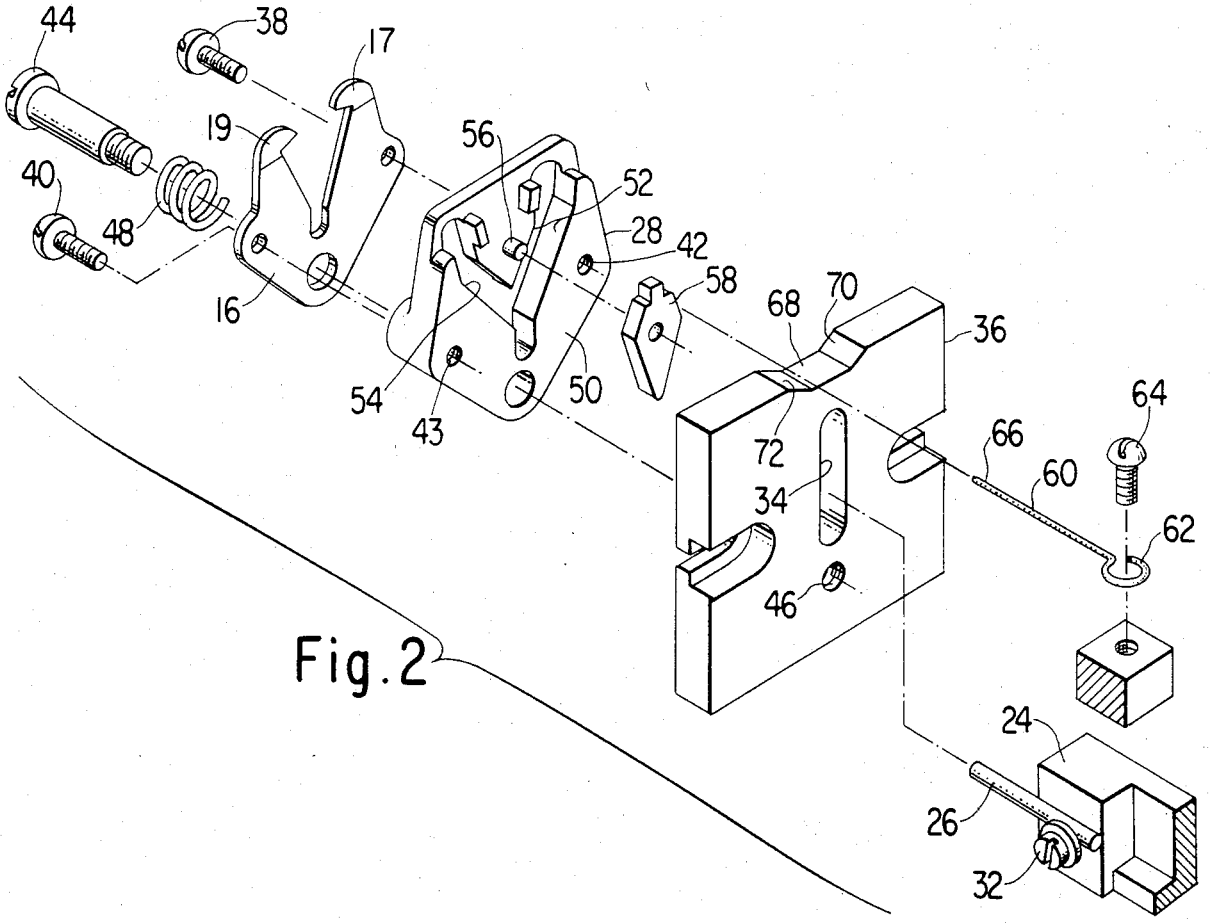
FIG. 2 is an enlarged exploded perspective view showing said cam controlled gate spring arrangement and looper actuating mechanism.

Referring to FIGS. 1 and 2 of the drawings, reference character 10 designates a hand held sewing machine including a frame 12, a thread carrying needle 14 arranged for reciprocating movement, and a pivotally movable looper 16 with opposing loop seizing points 17 and 19 which cooperate with the needle in the formation of chain stitches. A work feeding mechanism 18 is arranged to undergo movements in cooperation with those of the needle 14 and the looper 16 in a well known manner, to properly position a work piece. A hand operated lever 20 which is pivotally attached at one end 22 to the frame 12 is interconnected with the needle 14 and feed mechanism 18 to impart the desired movement thereto. Such interconnections may be effected as in the manner shown, for example, in the U.S. Pat. No. 4,411,210 of Karl H. Killinger for "Actuating Mechanism for a Double Pointed Looper in a Sewing Machine", and in his U.S. Patent application for "Feeding Mechanism for Double Pointed Looper Sewing Machine", Ser. No. 461,825, filed Jan. 28, 1983, now U.S. Pat. No. 4,463,695.

The hand operated lever 20 acts through a drive arm 24, (see FIG. 2), an actuator 26 in the form of a drive pin on the arm, and a pivoted cam 28 driven by the actuator to impart movement to the looper 16. The drive pin 26 is held in place on the free end of arm 24 by a suitable fastener 32, and extends through an elongated hole 34 in a guide block 36 which is rigidly attached to the frame 12, the elongated hole being arranged to slidingly receive drive pin 26 for the guiding thereof in a vertical plane. The drive pin further extends beyond the guide block to the cam 28 to provide for the actuation of the cam and thereby the looper 16 which is affixed to the cam with screw fasteners 38 and 40 that are threaded into holes 42 and 43, respectively, in the cam.

Cam 28 with attached looper 16 (designated in the drawings as assembly 82) is pivotally attached to guide block 36 with a screw fastener 44 which is threaded into a hole 46 formed in the guide block. A helical compression spring 48 disposed between the head of the screw fastener 44 and the looper 16 urges assembly 82 axially toward block 36 and so provides for sliding engagement of cam surface 50 with the block. The cam includes two cam tracks 52 and 54 which intersect at their lower extremities and receive an end portion of the drive pin extending through elongate hole 34 in block 36. Pin 26 which is vertically reciprocated by operation of handle 20 moves along the tracks to impart reciprocatory motion to the cam 28 and looper 16. Cam 28 includes a fixed pin 56 which pivotally supports a gate 58 for alternately blocking each of the two intersecting cam tracks 52 and 54 so that drive pin 26 can slidingly engage the other track to effect pivotal movement of the cam as described in the aforementioned U.S. Pat. No. 4,411,210, and as required to alternately place each of the two loop seizing points 17 and 19 on the looper into cooperative association with the needle for the formation of chain stitches in a manner well understood in the art. The gate is positioned in the manner described in the said U.S. Pat. No. 4,411,210 by drive pin 26 in conjunction with a spring 60 having one end 62 secured by a screw 64 to a fixed member in the machine and having an opposite free end portion 66 engageable with the gate. Spring 60 passes over block 36 and is engageable thereon with a spring supporting surface 68 and with spring camming surfaces 70 and 72.

Figure 5:
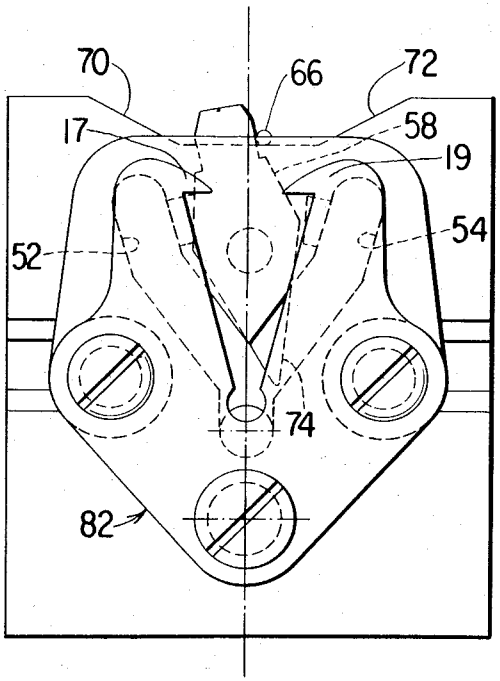
Figure 4:
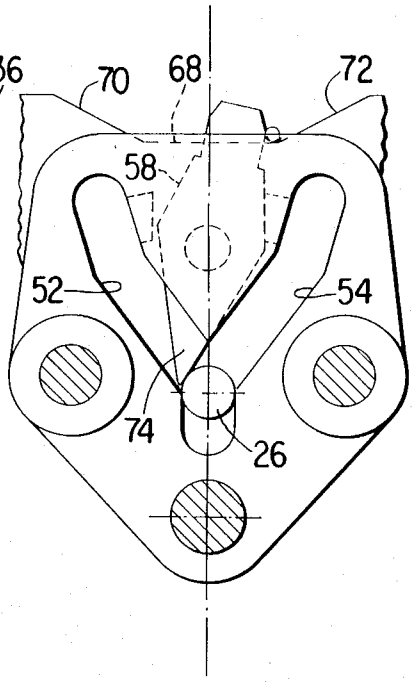

Referring to FIGS. 3 through 10 of the drawings, it may be seen that when pin 26 is in the upper end of cam track 54 (FIG. 3), looper 28 and therefor the looper cam assembly 82 is in an extreme leftward position, cam track 52 is blocked by the lower portion 74 of gate 58, and an upper portion 76 of the gate is to the left of free end spring portion 66 which is then unbiased in a supported position on surface 68 of guide block 36 midway between the lower ends of camming surfaces 70 and 72. Movement of pin 26 to the lower end of track 54 results in assembly 82 being moved clockwise, and free end portion 66 of spring 60 being flexed to the right by gate 58 (FIG. 4). When pin 26 moves into a connecting region 78 between tracks 52 and 54, gate 58 is moved by the free end 66 of spring 60 from the position blocking track 52 to a position wherein the lower end 74 of the gate is caused to block track 54, and track 52 is unblocked (FIG. 5).

Figure 6:
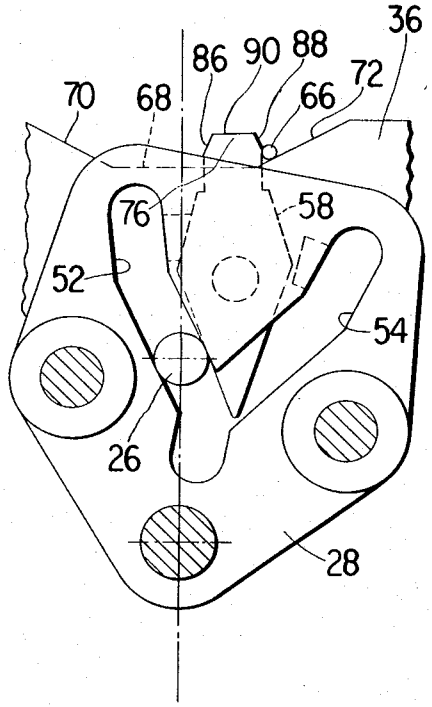
FIGS. 3 through 10 are enlarged end views showing the looper, gate and gate spring in various operating positions.
Figure 7:
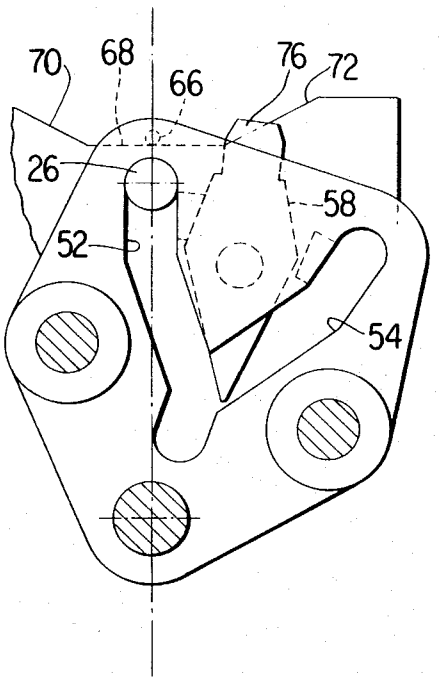

Pin 26 is moved upwardly from connecting region 78 into track 52 causing assembly 82 to be moved further in a clockwise direction, and free end spring portion 66 to be moved by gate 58 to the lower end of camming surface 72 on block 36 (FIG. 6). As the pin is moved further upwardly to the upper end of track 52, free end spring portion 66 is moved by the upper end portion 76 of gate 58 along camming surface 72, and is raised thereby to the top of the gate where the spring then passes over the gate to return to the unbiased position with the free end portion on surface 68 midway between supporting surfaces 70 and 72 (FIG. 7).

Figure 9:
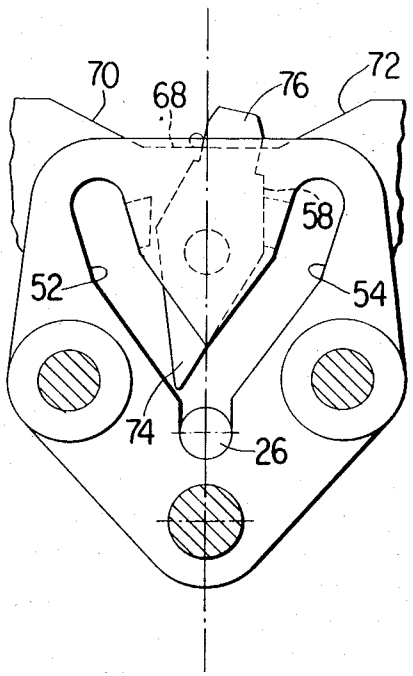
Figure 8:
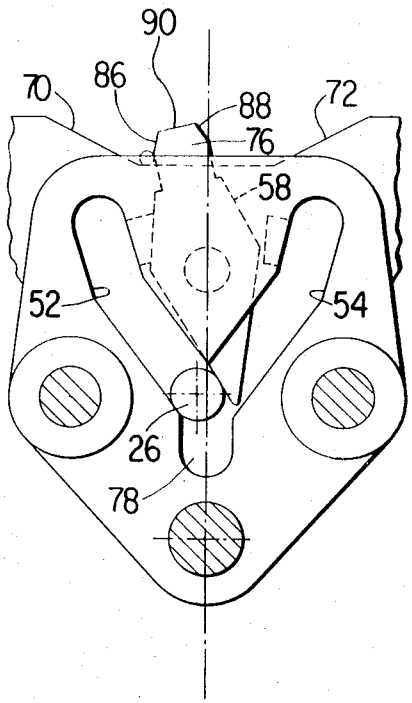

Pin 26 is moved downwardly from the upper end of track 52 to the lower end whereupon assembly 82 is moved counterclockwise, and the upper end portion 76 of the gate is caused to move spring end portion 66 to the left (FIG. 8). As the pin moves into gate connecting region 78, the gate is moved by spring end portion 66 to cause the lower end 74 of the gate to unblock track 54 and block track 52 (FIG. 9).

Figure 3:
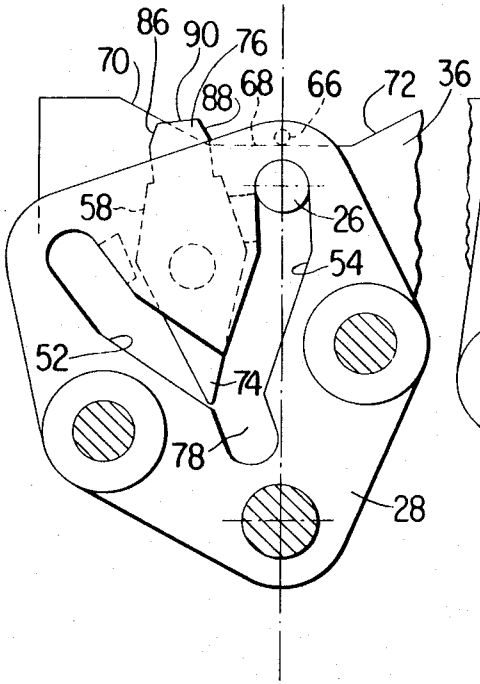
Figure 10:
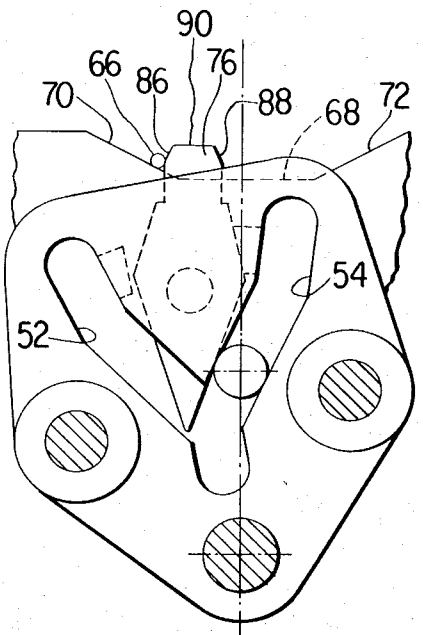

The pin moves from gate connecting region 78 into track 54 to pivot assembly 82 counterclockwise, and causing spring end portion 66 to be moved to the left by gate 58. Spring end portion 66 is moved first to the lower end of camming surface 70 (FIG. 10), and then along the camming surface. Camming surface 70 raises the spring end to the top of the gate and the spring passes over the top of the gate to return to an unflexed position on the surface 68 (FIG. 3).

As shown, the upper end portion 76 of the gate is formed with slopping side edges 86 and 88 which extend upwardly to a midline apex portion 90. Such slopping sides facilitate the movement of spring end portion 66 to the top of the gate by camming surfaces 70 and 72, and thereby passage from one side of the gate to the other.

It is to be understood that the present disclosure relates to a preferred embodiment of the invention which is for purposes of illustration only, and is not to be construed as limiting the invention. Numerous alterations and modification of the structures herein disclosed will suggest themselves to those skilled in the art, and all such modifications and alterations which do not depart from the spirit and scope of the invention are intended to be included within the scope of the appended claims.

I claim:

1. In a sewing machine; a needle, a frame, means mounted on the frame for reciprocating the needle; a looper and cam assembly, the cam including a pair of intersecting cam tracks, and said cam having a gate pivotally mounted thereon; resilient means biasing the looper and cam assembly axially into a limited position in the frame; an actuator engageable with the cam on said cam tracks in the limited position of the assembly for imparting reciprocatory pivotal movement to said assembly and disposing the looper points for cooperation with the needle in the formation of chain stitches; a spring having one end affixed in the machine and a free end to alternately engage opposite side edges of the gate and move the gate into positions controlling actuator movement between the tracks; and a fixed member having camming surfaces thereon engageable by the spring with flexure thereof by the gate for lifting the free end of the spring to the top of the gate for passage from one side to the other.

2. The combination of claim 1 wherein the spring is an elongate resilient member with a straight free end portion.

3. The combination of claim 1 wherein said fixed member includes an elongate slot and the actuator extends through the slot.

4. The combination of claim 1 wherein said camming surfaces extends along a top edge of the fixed member.

5. The combination of claim 4 wherein the top portion of the gate is formed with slopping side edges extending upwardly to a midline apex portion.

* * * * *